US007657117B2

(12) United States Patent
Saund et al.

(10) Patent No.: US 7,657,117 B2
(45) Date of Patent: Feb. 2, 2010

(54) METHOD AND APPARATUS FOR CALIBRATING A CAMERA-BASED WHITEBOARD SCANNER

(75) Inventors: Eric Saund, San Carlos, CA (US); Bryan Pendleton, Menlo Park, CA (US); Kimon Roufas, Cambridge, MA (US); Hadar Shemtov, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 420 days.

(21) Appl. No.: 11/017,439

(22) Filed: Dec. 20, 2004

(65) Prior Publication Data

US 2006/0132467 A1 Jun. 22, 2006

(51) Int. Cl.
*G09G 5/00* (2006.01)

(52) U.S. Cl. ..... 382/275; 345/178

(58) Field of Classification Search ..... 382/275; 345/178

See application file for complete search history.

(56) References Cited

U.S. PATENT DOCUMENTS 5,528,290 A * 6/1996 Saund ..... 348/218.1
5,768,443 A * 6/1998 Michael et al. ..... 382/294
6,100,881 A * 8/2000 Gibbons et al. ..... 715/500.1
6,346,933 B1 * 2/2002 Lin ..... 345/157
6,531,999 B1 * 3/2003 Trajkovic ..... 345/157
6,885,759 B2 * 4/2005 Cox et al. ..... 382/103
6,904,182 B1 * 6/2005 Simard et al. ..... 382/284
7,027,041 B2 * 4/2006 Nishimura et al. ..... 345/178
7,176,881 B2 * 2/2007 Nishimura et al. ..... 345/156

OTHER PUBLICATIONS

Kato and Billinghurst "Marker Tracking and HMD Calibration for a Video-based Augmented Reality Conferencing System" 2nd IEEE and AMC International Workshop on Augmented Reality, 1999, pp. 85-94 ("Kato").*

* cited by examiner

*Primary Examiner*—Charles Kim
*Assistant Examiner*—Stephen R Koziol
(74) *Attorney, Agent, or Firm*—Fay Sharpe LLP

(57) ABSTRACT

In accordance with one aspect of the present exemplary embodiments, a calibration arrangement is configured to assist in calibration of a surface scanning system where the calibration arrangement includes a preconfigured physical object which may embody dimensional information wherein the dimensional information is used to calibrate a surface of the scanning system. In an alternative embodiment, the preconfigured physical object is configured to obtain data for use in calibration of the surface of a pan/tilt surface scanning system.

12 Claims, 7 Drawing Sheets

METHOD AND APPARATUS FOR CALIBRATING A CAMERA-BASED WHITEBOARD SCANNER

BACKGROUND

The present exemplary embodiments relate to electronic imaging, and more particularly to calibration of electronic whiteboard scanner systems.

A variety of electronic whiteboard image acquisition systems exist. One particular type employs a fixed camera arrangement to capture an image or markings located on a whiteboard. A second imaging system, is a whiteboard scanner which employs a pan, tilt, zoom camera arrangement to capture a high-resolution image of a whiteboard by mosaicing a large number of overlapping, zoomed-in images, or snapshots, covering the whiteboard. In order for the overlapping snapshots to align properly in the final image and not show stitching seams, substantial image processing is performed.

U.S. Pat. No. 5,528,290, "Device For transcribing Images On A Board Using A Camera Based Board Scanner", which is incorporated herein in its entirety, describes a whiteboard system. This patent discloses a stitching program/algorithm for stitching together snapshots taken by the camera. The algorithm requires an initial estimate of the image transform parameters required to perform the perspective deformation, for mapping each snapshot into the whiteboard coordinate system. The stitching refinement algorithms will generally succeed to properly align snapshots when the initial estimate places marks on the whiteboard viewed by separate snapshots within a few inches from one another in the whiteboard coordinate system.

This initial estimate of transform parameters requires an accurate kinematic model of the camera with respect to the global whiteboard coordinate system. The calibration parameters may include the following: camera location (3 parameters), camera pan axis direction (2 parameters), camera pan & tilt offset angles (2 parameters), image sensor offset from pan/tilt axis intersection (2 parameters). In addition a final parameter describes the rotation of the image sensor about the camera optical axis.

Currently, these parameters are obtained through a rather tedious camera calibration procedure. The user must measure out approximately nine known x-y positions on the whiteboard with a tape measure. These are required to substantially span the entire height and width of the whiteboard. The user enters these measurements into a calibration data file which is later accessed by a camera calibration solver program/algorithm. The user is then required to direct the camera to point at each of these locations. The pan and tilt camera positions corresponding to each known whiteboard location are then added to the calibration data file. This procedure is carried out using an interactive program whereby the user views a through-the-lens image and controls the camera's pan, tilt, and zoom using the computer mouse, until an overlay circle projected at the camera's optical center location aligns with the target marking. When the user is satisfied the camera is pointing as accurately as possible to the target mark, they click a mouse button causing the program to record the camera's current pan and tilt positions into the calibration data file. This is done in turn for each of the target locations on the whiteboard.

The user then invokes the calibration solver program to estimate the kinematic parameters of the camera. The solver program starts with rough initial estimates of each of the kinematic model parameters. These estimates enable the program to predict the whiteboard x-y coordinates for each target location based on the pan/tilt angles recorded when the user directed the camera to point at these locations. The calibration solver uses a clocked conjugate gradient descent algorithm to refine the kinematic parameter estimates to optimize these predictions with respect to the measured x-y coordinates for each calibration target. The kinematic model is thereafter used to calculate the parameters of an initial "dead-reckoning" projective transform mapping each image snapshot into the whiteboard coordinate system.

The current data acquisition procedures are tedious and error-prone. They require the user to perform many distance measurements between markings placed on the whiteboard. For large whiteboards, the distances can be several feet. It is difficult for a user to manage a tape measure for this distance over a vertical surface. Ideally, the distances should measure to an accuracy of ⅛ inch or better, which is difficult for many untrained users. Then, the user must enter the measured distances into the computer. Among the ways errors can arise are, mistakes in inputting the numbers, mistakes in correctly associating measurements with the target points they correspond to, and mistakes of transposing the x (horizontal) and y (vertical) values.

Additional discussions regarding known pan/tilt camera calibration methods may be found in James Davis and Xing Chen, "Calibrating Pan-Tilt Cameras in Wide-Area Surveillance Networks", International Conference on Computer Vision, 2003, hereby incorporated in its entirety.

As previously mentioned, in addition to a whiteboard scanning system which employs a pan/tilt camera arrangement, other video electronic whiteboard scanner systems employ fixed camera arrangements to capture images on a whiteboard. One such system is known as the Camfire DCi Whiteboard Camera System. In the installation guide for this device, users are instructed to mark the center of the whiteboard at a top and bottom location on the writing surface. Thereafter, image targets are aligned at the top and bottom corresponding to the marked approximate center surface. In a third step, corner-image targets are placed in the corners of the whiteboard, and a center-image target is placed at the approximate center of the whiteboard. In this procedure, the user is not instructed to perform any measurements related to the image targets, and therefore the image targets contain no form of dimensional calibration information. Once these image targets are in place, the user follows instructions on a control unit where the system performs a calibration operation, wherein if the horizontal lines in a saved image are unbroken, then the alignment is determined to be successful and the image targets may be removed.

Calibration of the fixed camera arrangement requires less data than needed in a pan/tilt camera environment. For calibrating a fixed camera system, what is desired is to determine how a rectangle in the real world projects into a rectangular figure in an imaging system. Particularly, an image in the real world may become distorted and project to some form of quadrilateral. Therefore, if you have the corresponding points between the corners of the quadrilateral and what is known to be a rectangle in the real world, then it is possible to undo this transformation so that the image, which is obtained after image processing, again looks like a rectangle.

The calibration technique for a fixed camera system (as opposed to a pan/tilt system) does not need to know specific distances between the image targets, nor to have image targets provide any dimensional information. These differences exist since the fixed camera system has less complexity in its image gathering than a pan/tilt system.

Thus, existing systems in the pan/tilt area are complicated and tedious, requiring a user to have a high degree of knowledge of the calibration techniques. Further, the fixed-camera system calibration techniques do not provide sufficient information which may be used for a proper calibration in a pan/tilt environment.

BRIEF DESCRIPTION

In accordance with one aspect of the present exemplary embodiments, a calibration arrangement is configured to assist in calibration of a surface scanning system where the calibration arrangement includes a preconfigured physical object which may embody dimensional information wherein the dimensional information is used to calibrate a surface of the scanning system. In an alternative embodiment, the preconfigured physical object is configured to obtain data for use in calibration of the surface of a pan/tilt surface scanning system.

DETAILED DESCRIPTION

Figure 1:
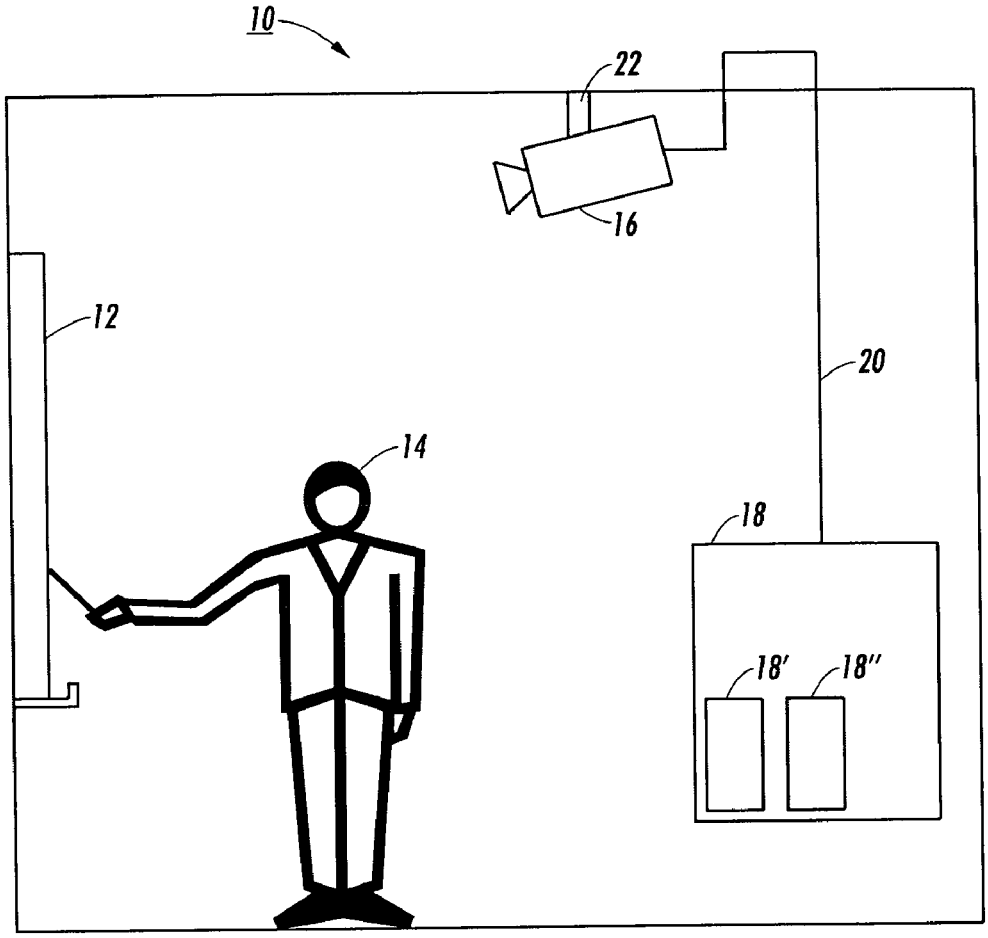
FIG. 1 illustrates a system describing the features of an electronic whiteboard system employing a pan/tilt camera arrangement.

FIG. 1 shows a scanning system 10 with which aspects of the exemplary embodiments may be employed. A board 12 accepts markings from a user 14. A "Board" may be either a whiteboard, blackboard or other similar wall-sized surface used to maintain hand drawn textual and graphic images. The following description is based primarily on a whiteboard with dark colored markings. It will be clear to those in the art that a dark colored board with light colored marking may also be used, with some parameters changed to reflect the opposite reflectivity.

Camera subsystem 16 captures an image or images of the Board, which are fed to computer 18 via a network 20. Computer 18 includes a processor and memory for storing instructions, data and electronic and computational images, among other items. Among the programs or algorithms stored in the computer 18, are computer vision recognition software 18', as well as calibration software 18".

In general, the resolution of an electronic camera such as a video camera will be insufficient to capture an entire Board image with enough detail to discern the markings on the Board clearly. Therefore, several zoomed-in images of smaller subregions of the Board, called "image tiles," are captured independently, and then pieced together.

Camera subsystem 16 is mounted on a computer-controlled pan/tilt head 22, and is directed sequentially at various subregions, under program control, when an image capture command is executed. For the discussion herein, camera subsystem 16 may be referred to as simply camera 16.

Figure 2:
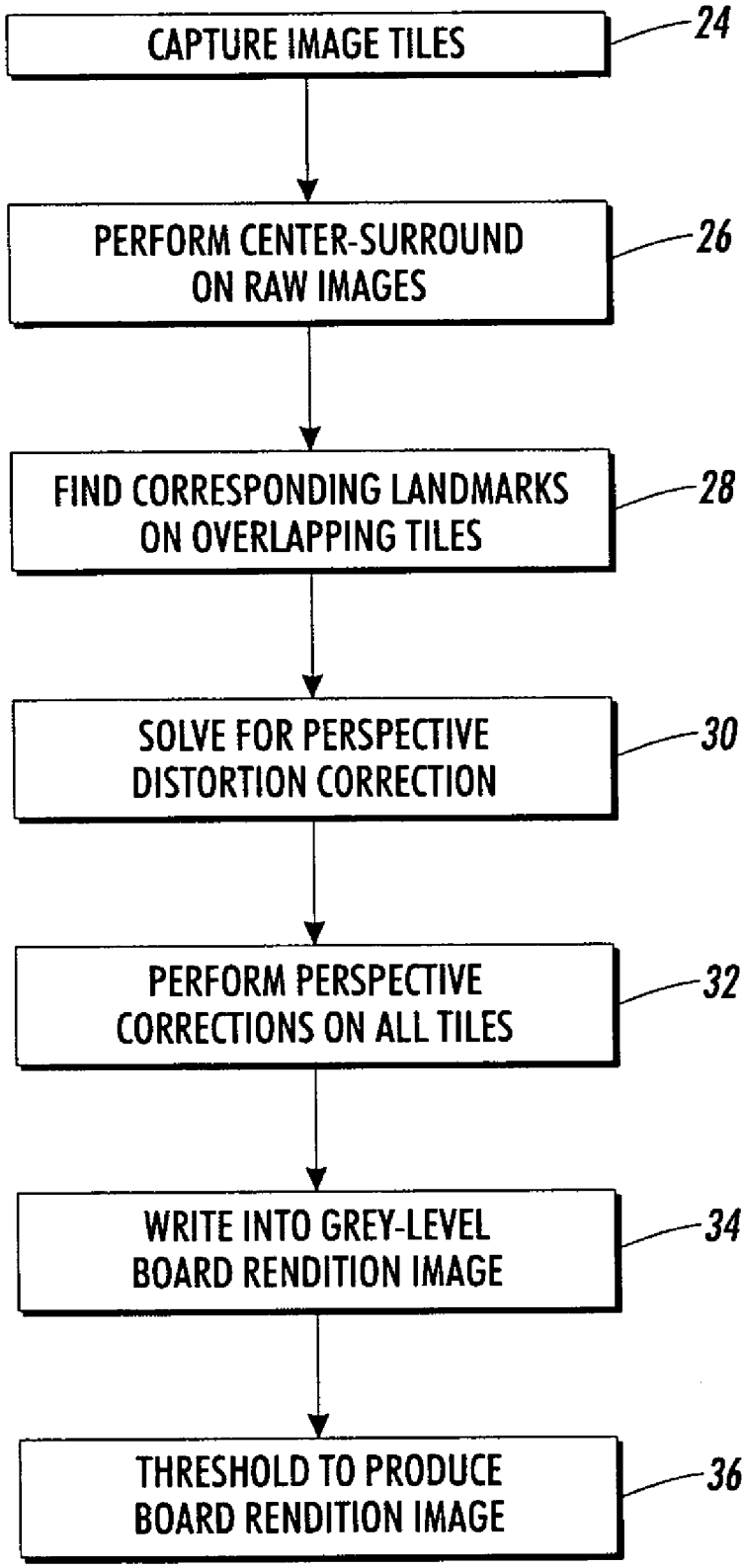
FIG. 2 shows a flow chart for the general method for producing a binary rendition of the board from a set of scanned image sections.

The flowchart of FIG. 2 sets forth a method for producing a binary rendition of the Board from a set of scanned image sections. In step 24, the scanned image sections are captured as tiles. Each tile is a portion of the image scanned by a camera. Board 12 is captured as a series of tiles, etc. The tiles slightly overlap with neighboring tiles, so the entire image is scanned with no "missing" spaces. In a system which has been properly calibrated, the location of each tile is known from the position and direction of the camera on the pan/tilt head when the tile is scanned. The tiles may be described as "raw image" or "camera image" tiles, in that no processing has been done on them to either interpret or precisely locate them in the digital image.

Center-surround processing is performed, in step 26, on each camera image tile. Center-surround processing compensates for the lightness variations among and within tiles.

Next, in step 28, corresponding "landmarks" in overlapping tiles are described as marks on the Board which appear in at least two tiles, and may be used to determine the overlap position of adjacent neighboring tiles in order to obtain a confidence rectangle. Landmarks may be defined by starting points, end points, and crossing points in their makeup.

Step 30 solves for perspective distortion corrections that optimize global landmark mismatch functions. This step corrects for errors that occur in a dead reckoning of the tile location in the image. The transformation is weighted by the confidence rectangle obtained in the previous step.

The landmarks are projected into Board coordinates. The first time this is performed, dead reckoning data is used to provide the current estimate. In later iterations, the projections are made using the current estimate of the perspective transformation.

Step 32 performs perspective corrections on all the tiles using the perspective transformation determined in step 30. In step 34, the corrected data is written into the grey-level Board rendition image. In step 36, the grey-level image is thresholded, producing a binary rendition of the Board image for black and white images, or a color rendition of the Board image in color systems.

The foregoing describes a whiteboard system and a process description of its operation. A more detailed explanation may be had by reference to U.S. Pat. No. 5,528,290. It is to be appreciated the above described process and other such processes will only work if the system has been properly calibrated. Commonly, a calibration procedure is undertaken when a system is installed, or When components of the system have, intentionally or unintentionally, been moved.

As described in the Background, existing calibration procedures are time consuming, difficult to implement and prone to error. The following exemplary embodiments provide objects/arrangements and methods to simplify the calibration procedure from the standpoint of the user. Particularly, the described objects/arrangements are provided to be affixed to Board 12. The objects or arrangements are formed so they are easily recognized by the computer vision system operating in conjunction with camera 16 and computer-controlled pan/tilt head 22. These objects/arrangements are constructed to embody pre-calibrated measurements of distances and angles, relieving the user 14 from having to perform numerous tedious and error-prone measurements and data entry operations.

Figure 3:
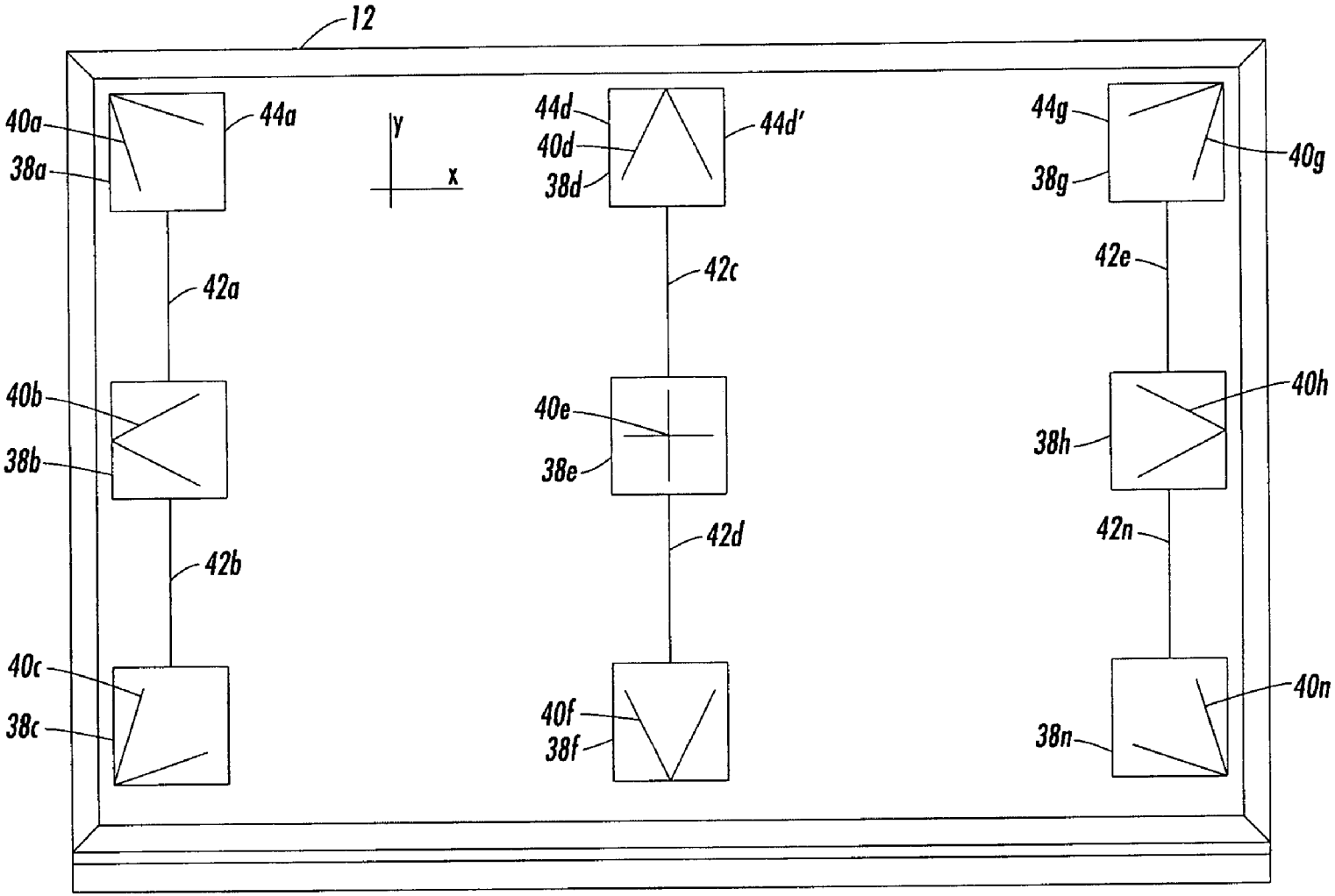
FIG. 3 illustrates a first exemplary embodiment of objects/arrangements useful in calibration process in a pan/tilt scanning system.

Turning to FIG. 3, illustrated is an exemplary embodiment of preconfigured physical objects/arrangement embodying dimensional information, wherein the dimensional information is used to calibrate a surface of scanning system. Positioned on board 12 are a plurality of preprinted cards 38*a*-38*n* of known dimensions. The cards 38*a*-38*n* have fiducial marks (e.g., arrows and cross-hair) 40*a*-40*n*. At least some of cards 38*a*-38*n* are joined to one another by connectors 42*a*-42*n* having known lengths. These connectors may be strings or wires. Through the use of the described object/arrangements (38*a*-38*n*, 40*a*-40*n*, 42*a*-42*n*) and known computer vision algorithms, employed in system 10, locations of objects 38*a*-38*n* within the Board's x,y coordinate system are determined automatically, or with a minimum number of measurements made on the part of the user.

For example, a user will hang a first card 38*a* in an upper left-hand corner of board 12. Connected to card 38*a* via connector 42*a* is card 38*b*. Similarly, card 38*c* is connected to card 38*b* via connector 42*b*. Cards 38*a*, 38*b* and 38*c* are each of a known length and width. Connectors 42*a* and 42*b* are of a known length. A second set of cards and connectors (e.g., cards 38*d*, 38*e*, 38*f* and connectors 42*c* and 42*d*) are placed in the middle of Board 12, and a third set of cards and connectors (e.g., 38*g*, 38*h*, 38*n* and strings 42*e* and 42*n*) are placed in the right-hand of the Board, where card 38*g* is placed in the upper right-hand corner. The top row cards (38*a*, 38*d* and 38*g*) may be affixed to the Board in any known temporary manner, such as by tape, or if the board is metal, a magnetic backing. The lower cards hang passively from the connectors. The user measures the distance between selected cards. Using just two measurements, and entering these two measurements into computer 18, a stored algorithm uses the data to determine the x,y locations for each of the cards.

Turning to a specific example, card 40*a* is in the upper left-hand corner of Board 12, and therefore, the point of arrow 40*a* is considered to be at the 0,0 location in the x,y coordinate system. The user measures, in one embodiment, from the right edge 44*a* of card 38*a* to the left edge of 44*d* of card 38*d*. To obtain the distance from the point of arrow 40*a* to the point of arrow 40*d*, the width of card 38*a* and the half-width of card 38*d* are added to the measured distance. Therefore, if the length measured is 40", plus it is known the dimensions of the cards are 6" by 6", then the width of card 38*a* (i.e. 6") is added along with half the width of card 38*d* (i.e., 3"), whereby the total distance between the points of arrows 40*a* and 40*d* is 49". Thereafter, a similar measurement is made from the left edge 44*d* of card 38*d* to the left edge 44*g* of card 38*g*. If this distance is again 40", then the total distance between the point of arrow 40*d* and the point of arrow 40*g* would again be 49". The user may enter the two distance measurements (i.e. at 40") or the calculated distances (i.e. at 49") into the computer 16 depending on the requirements of the particular algorithm. In a case where the distance measurements (i.e. 40") are entered, the algorithm, which will have been provided with the known dimensions of the cards and connectors, will calculate the arrow to arrow distance (i.e. 49") and then will calculate the locations of the remaining cards. When the calculated distance is entered (i.e. 49"), the algorithm will use this information and the known dimensions of the cards and connectors to calculate the locations of the remaining cards.

In an alternative measuring procedure, the user may directly measure from the point of arrow 40*a* to the point of arrow 40*d*, and again from the point of arrow 40*d* to the point of arrow 40*g* to obtain the measurements, which in the example were 49". These distances may be entered into the computer system, which will use this information then determine the locations of the printed cards in the x,y coordinate system of whiteboard 12.

More particularly, using any of the above techniques, the computer system is configured to associate that 38*a* (in the upper left-hand corner) would have the point of arrow 40*a* at x,y coordinate location 0,0. Then having the known dimensions of the cards (6" by 6", for example) and the distance of the connectors 42*a*-42*n* (20"), the computer system will automatically determine that 38*b* has the point of its arrow 40*b* at x,y coordinate 0,29 (i.e., when the string is 20" long, card 38*a* is 6" in length, and half of card 38*b* is 3"). A similar calculation is made for card 38*c*, showing that it would be at x,y coordinate 0,58. Thereafter, using the inputted information by the user, the point for arrow 40*d* of card 38*d* is known to be at the x,y coordinate 49,0; the intersect of cross-hair 40*e* of card 38*e* is at x,y coordinate 49,29; and the point of arrow 40*f* of card 38*f* is at x,y coordinate 49,58.

To fully show the coordinate system mapping, the point of arrow 40*g* of card 38*g* is at x,y coordinate 98,0; the point of arrow 40*h* of card 38*h* is at x,y coordinate 98,29, and the point of arrow 40*n* of card 38*n* is at x,y coordinate 98,58.

Thus, by making two measurements and supplying those measurements to the computer, the system uses the acquired information, and previously provided information to assist in the performance of the calibration procedure.

It is to be appreciated that while a nine-card system is used herein, other arrangements may be used where another number of cards may be employed, as well other lengths of connectors. For example, more cards may be located within the vertical direction, or additional card sets may be used in the horizontal direction. Additionally, while the measurements were made in connection with the upper row of cards, they may be made with the middle or lower rows also. Still further, to automate the arrangement even more, connectors of known lengths may be used between the cards in the horizontal direction.

Using techniques known in the art, the computer vision system is programmed to detect the cards on the basis of color or identifiable shape characteristics. It is further programmed to zoom in and zero in on fiducial locations on the cards, such as the intersections of lines, through an interative servoing process. The cards and their connecting strings are constructed to be of known dimensions.

Figure 4:
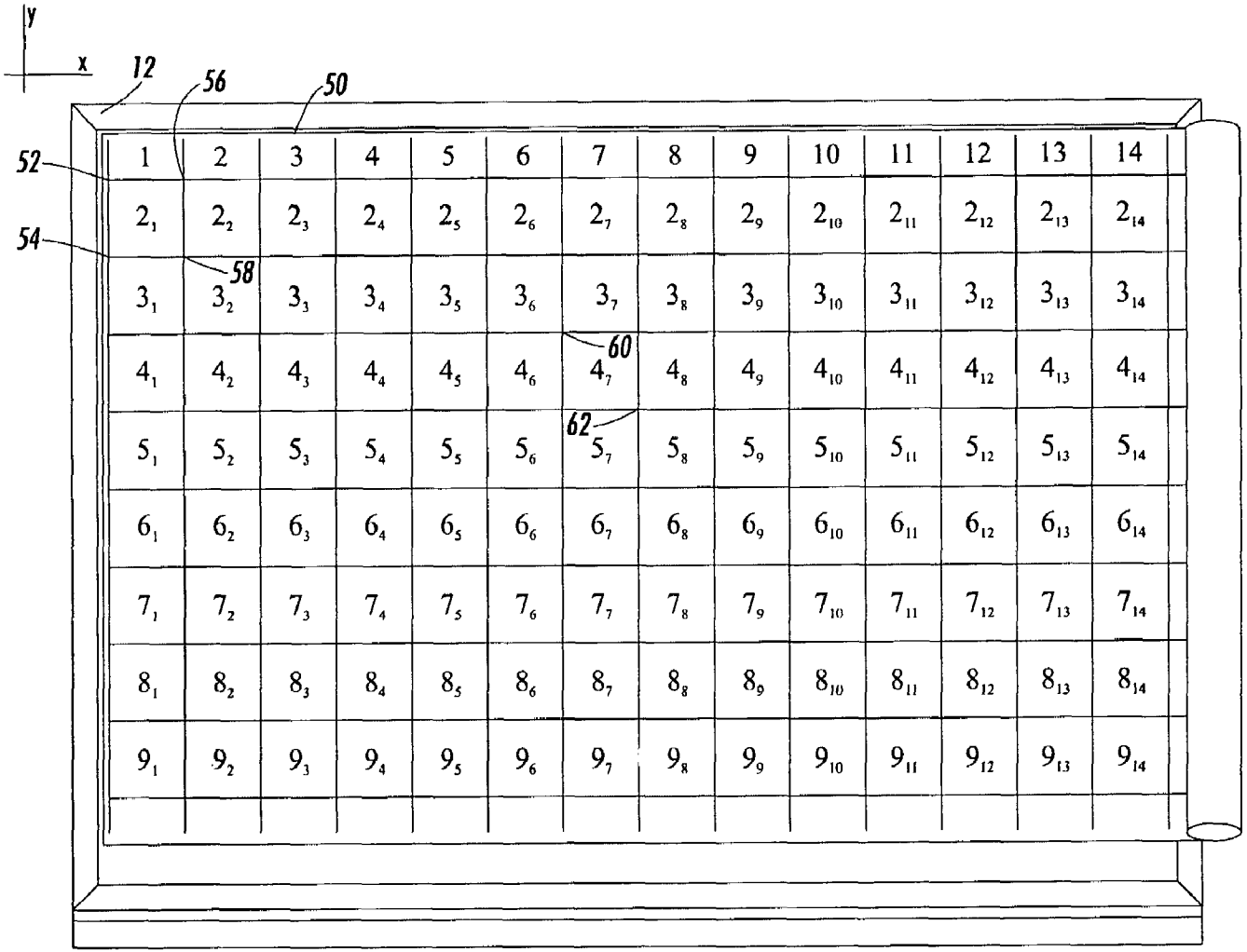
FIG. 4 is a second exemplary embodiment of a object/arrangement for use in a pan/tilt camera arrangement.

Turning to FIG. 4, shown is another exemplary embodiment of the present application. In this embodiment, one or more preprinted paper sheets 50 is provided for the user to unroll and affix to the whiteboard 12 to assist in the calibration process. The paper contains certain markings easily identifiable by a computer vision system, that enable such a system to zero in on the pan/tilt angles required to direct the camera at these markings whose locations are known. The markings may take the form of a grid, used to provide positional data. Particularly, in this embodiment the upper left-hand grid point would be located at position 1,2 in the x,y coordinate system. Each of the grid points, e.g., 1 to $9_{13}$, in the figure (although of course more blocks and/or different sized blocks may be used) has a known spacing such as 6" and a unique identification component (e.g., 1-$9_{13}$) at grid line intersection points, stored in the computer. Because the grid does not extend to the edges of the paper on which the grid is printed, placing the upper left corner of the grid 1 at the 0,0 point in the whiteboard coordinate system means the upper left grid point 52, is located at the x,y coordinate 1,2 in the whiteboard coordinate system. Thus each of the intersections of the blocks would be known in the x,y coordinate system. For example, point 54 would be at the x,y coordinate 0,8 position, point 56 at the x,y coordinate 7,2 position, and point 58 at the x,y coordinate 7,8 position. By this arrangement, the computer vision system may view any subset of grid points and their x,y positions determined. For example, the grid spacing determines that intersection 60 is at an x,y coordinate 43,20. This information is obtained automatically by the calibration algorithm without the requirement of the user measuring any positions on Board 12.

In a variant on this embodiment, the preprinted markings of page 50 may be affixed to the whiteboard as part of the manufacturing process, for example, as a removable adhesive sheet or film. Once the whiteboard has been mounted in an office or conference, and the camera calibrated, the film is peeled away leaving a blank whiteboard surface. In this embodiment, there is no user measurement or application of the material required.

Figure 5:
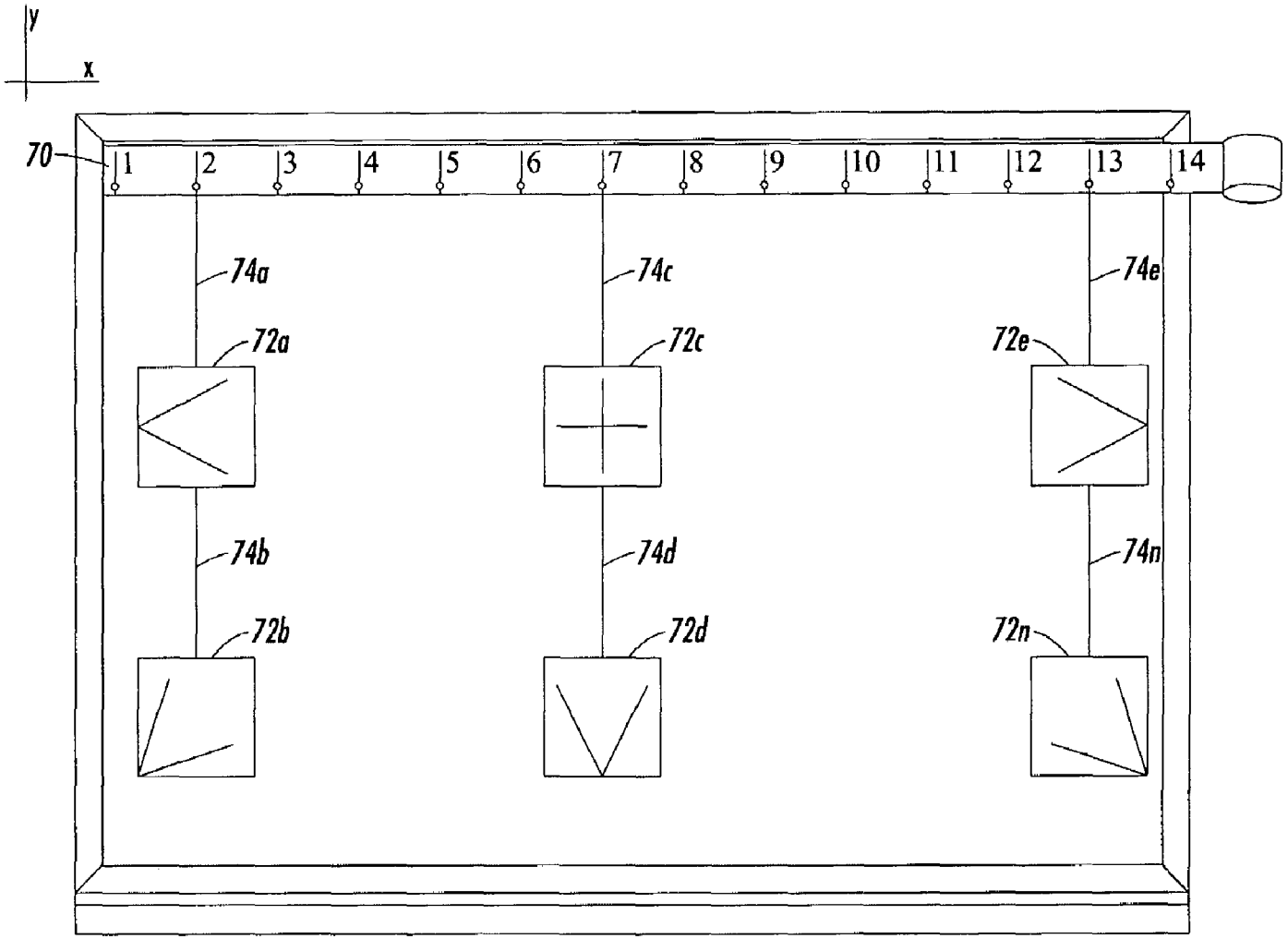
FIG. 5 is a further exemplary embodiment of a hybrid object/arrangement for use in the calibration process of a pan/tilt camera arrangement.

Turning to FIG. 5, another exemplary embodiment combines the use of a pre-printed paper roll 70 to establish horizontal distances, with other objects/arrangement, such as cards 72*a*-72*n*, selectively interconnected by connectors 74*a*-74*n* that the user affixes to the paper that hang down to establish the locations of fiducial points lower on Board 12.

The user is instructed to roll out pre-printed paper roll 70 and affix it to the whiteboard. The paper roll 70 may be affixed, temporarily, to Board 12 by tape, or if Board 12 is metal, by a magnetic connection. The user is instructed next to hang the cards 72*a*-72*n* from holes 74 near the left, center, and right sides of Board 12 as shown. No measurement is required on the part of the user. The computer vision system is programmed to detect the cards 72*a*-72*n* and the connectors 74*a*-74*n* they are hung from, and recognize the number associated with the hole the strings are hooked through. The numbers in roll 70 correlate to specific x,y coordinates. The card and connectors are, again, of known dimensions, whereby the location data may automatically be obtained. Thus, this exemplary embodiment eliminates the measurement steps undertaken in connection with the embodiment of FIG. 3. With continuing attention to FIG. 5, while six cards and four connectors are shown, other numbers of cards, and connectors may also be used.

Figure 6:
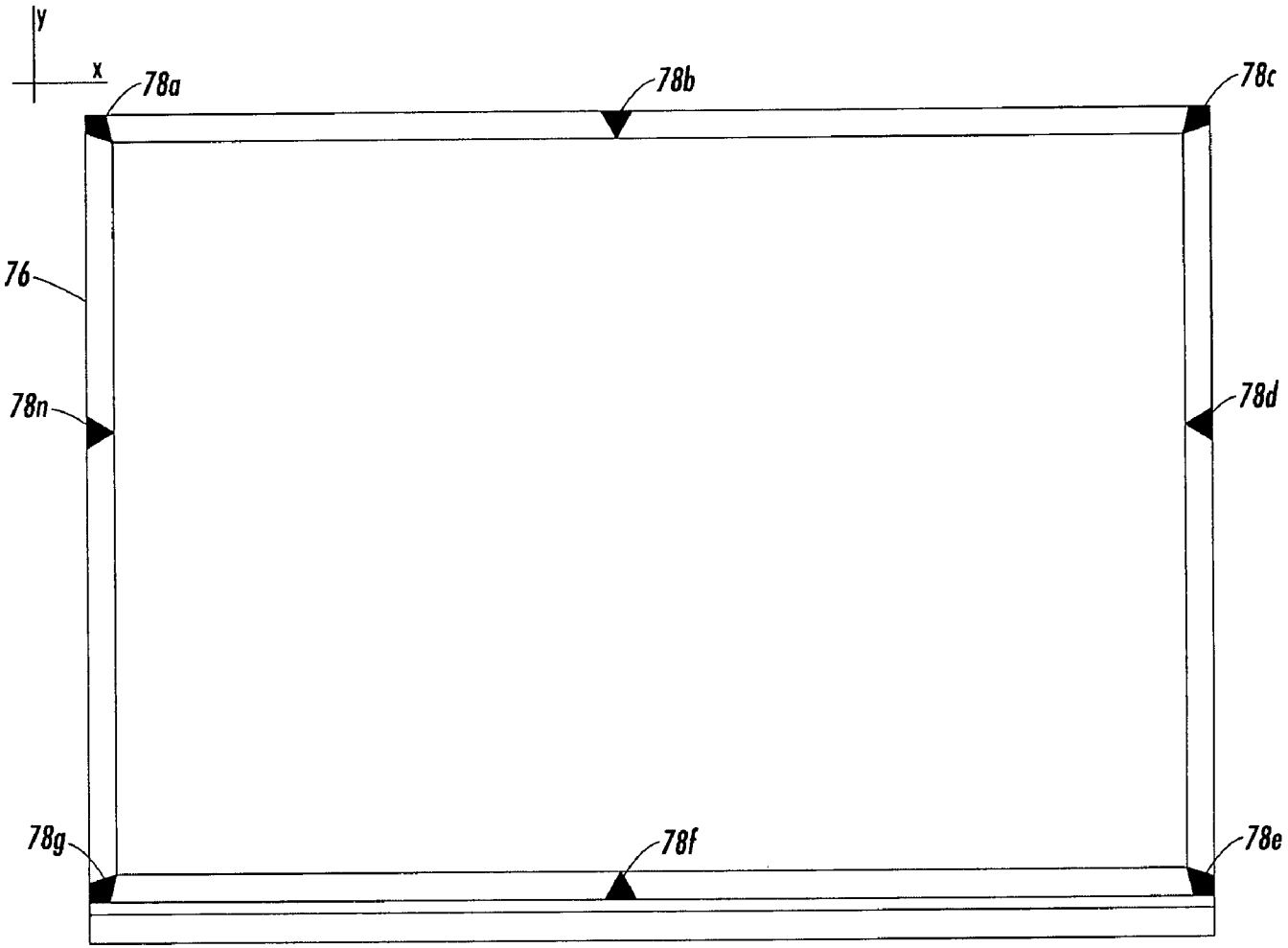
FIG. 6 sets forth a further embodiment to assist in the calibration of a pan/tilt camera arrangement; and, FIG. 7 sets forth a flow chart for use of the arrangements of FIGS. 3-6.

Another exemplary embodiment shown in FIG. 6 is to use computer vision algorithms to recognize visual events at known locations associated with the Board 12 itself. Specifically, for a Board 12 of a known dimension and constructed with a frame 76, computer vision algorithms are used to identify the corners and other points on the frame which are indicated with special markings such as arrows 78*a*-78*n*. These arrows are used as calibration marks without the user having to affix any special objects to the board or perform any measurements. The computer vision algorithm is designed to identify the upper-left most arrow 78*a* as pointing to the 0.0 location of the x,y coordinate system. Then having the distances between arrows known and provided in the algorithm, the locations of the remaining arrows can also be determined. In a manner similar to the previous embodiments, the algorithm or user controls the camera to scan Board 12 in a particular pattern, which permits the next recognized arrow to be associated with the appropriate x,y coordinate location. For example in FIG. 6, after locating arrow 78*a*, the camera will scan to the right (in the same horizontal plane as arrow 78*a*). When it detects and recognizes arrow 78*b*, the algorithm will associate this arrow with the appropriate x,y coordinate location as stored in the computer.

Figure 7:
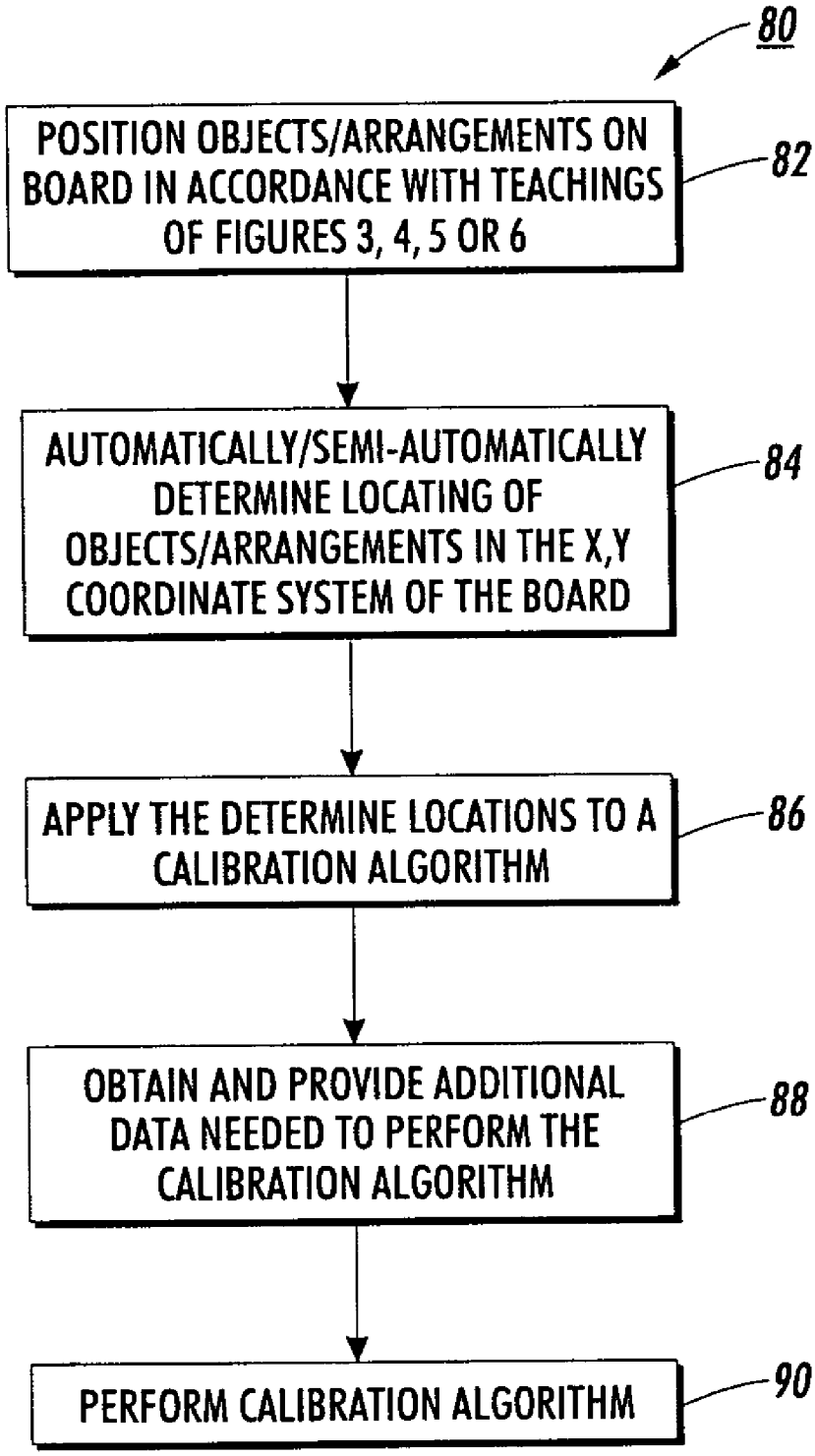

FIG. 7, is a generalized flow chart 80 showing steps for use of the objects/arrangements described in the preceding figures. In step 82, the objects/arrangements are located on the board in accordance with the teachings of FIGS. 3, 4, 5 or 6. Particularly, the user will arrange the objects on the board as discussed in connection with these figures. Or in an alternative embodiment, the positioning may occur prior to shipment of the whiteboards wherein any of the embodiments shown in the figures may be pre-applied. A particular aspect of this is in connection with FIG. 6 where the locating arrows may be positioned permanently or semi-permanently to the board since they are located in the frame of the board and not on the actual writing surface.

Following positioning of the objects/arrangements, in step 84 there is an automatic or semi-automatic determination of the locations of the objects/arrangements in the x,y coordinate system of the board. Particularly in the semi-automatic environment, the user is required to make certain measurements, and enter the measurements into the computer system. These measurements may then be used in determining the locations of the objects in the x,y coordinate system. This semi-automatic operation is particularly applicable to the embodiments of FIGS. 3 and 5. Once the measurements are entered, or the system automatically begins its operation, the locations of the objects/arrangements in the x,y coordinate system are determined in accordance with the embodiments of the foregoing figures. Thereafter, in step 86, the x,y coordinate information is stored in a calibration data file within the computer system which may be later accessed by a camera calibration program/algorithm for use in the calibration process. It is also understood that additional calibration data may be required, and therefore in step 88 this information is obtained and provided to the algorithm used to perform the calibration. Once all the required data has been obtained, or in situations where calibration data is obtained during the calibration process, performance of the calibration algorithm is undertaken in step 90.

The advantages of the foregoing concepts are greater speed and accuracy of camera calibration, less chance of user error, greater convenience to the user, and less skill or training required on the part of the user. The dimensional information embodied or included in the physical arrangement, include the known dimensions or configurations of the objects, connectors, rolls, substrates and the fiducial marks located thereon. Thus, dimensional information is also obtainable from the positioned relationships between the objects, connectors, rolls substrates and the fiducial marks located thereon. Also, while the foregoing has been primarily discussed in connection with a pan/tilt camera arrangement, it may also be used in a fixed camera system and a system using an array of cameras, among others.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. A calibration apparatus configured to assist in calibration of a surface scanning system, the calibration apparatus comprising:

a preconfigured physical arrangement embodying dimensional information, wherein the pre-configured physical arrangement comprises a substrate having a plurality of objects having printed fiducial markings at pre-determined locations on the substrate, the pre-determined locations being of a known distance from each other, and the plurality of objects having known dimensions, and the pre-configured physical arrangement further comprises a plurality of connection members connecting at least some of the plurality of objects to each other, the connection members having a known dimension, wherein at least some of the plurality of objects are selectively associated with the substrate via at least some of the plurality of connection members, wherein the known dimension of each connection member is utilized to facilitate calibration of the surface scanning system.

2. The calibration apparatus according to claim 1, wherein one of the objects is located in an upper left-hand corner of a board corresponding to a 0,0 x,y coordinate location of the board.

3. The calibration apparatus according to claim 1, wherein a first set of the plurality of objects include a first object, a second object and a third object, the first and second objects connected together via a first connector and the second and third objects connected together via a second connector, wherein when the first object is positioned on a board, the second and third objects are positioned below the first object.

4. The calibration apparatus according to claim 1, wherein the scanning system includes a pan/tilt camera arrangement.

5. The calibration apparatus according to claim 1, wherein the fiducial marks of the substrate and the fiducial marks of the objects detectable by a vision recognition system.

6. A calibration apparatus arrangement configured to assist in calibration of a pan/tilt based surface scanning system, the calibration apparatus arrangement comprising:

a board having a surface;

a preconfigured physical arrangement which embodies dimensional information, wherein the pre-configured physical arrangement comprises a substrate having a plurality of objects having printed fiducial markings at pre-determined locations on the substrate, the pre-determined locations being of a known distance from each other, and the plurality of objects having known dimensions, and wherein the known dimension of each of the objects is utilized to facilitate calibration of the surface scanning system;

a pan/tilt head;

a camera mounted on the pan/tilt head positioned to record an image of the board, a resolution of the camera being insufficient to capture the image of the entire board, wherein the camera captures images of subregions of the board; and a computer system in operative communication with the camera, the computer system including computer vision recognition software and calibration software, the computer vision software being reconstruction software designed to reconstruct the image of the entire board using the subregion images, wherein the calibration software uses the preconfigured physical arrangement to calibrate operation of the camera to capture the images of the subregions of the board to reconstruct the image of the entire board.

7. The calibration apparatus according to claim 6, wherein the pre-configured physical arrangement includes, a plurality of objects having fiducial marks, the plurality of objects having known dimensions, and a plurality of connection members connecting at least some of the plurality of objects to each other, the connection members having a known dimension.

8. The calibration apparatus according to claim 6, wherein the preconfigured physical arrangement is comprised of a substrate divided into positional areas describing positional data, the positional areas divided into known dimensions and each of the positional areas have a unique identification component, wherein each of the positional areas are uniquely identifiable.

9. The calibration apparatus according to claim 6, wherein the pre-configured physical arrangement is comprised of, a substrate having printed fiducial markings at pre-determined locations on the substrate, the pre-determined locations being of a known distance from each other, a plurality of objects having fiducial marks, the plurality of objects having known dimensions, and a plurality of connection members connecting at least some of the plurality of objects to each other, the connection members each having a known dimension at least some of the plurality of objects selectively associated with the substrate via at least some of the plurality of connection members.

10. The calibration apparatus according to claim 9, wherein the preconfigured physical arrangement is a series of fiducial marks located on a frame portion of a board, and the fiducial marks are positioned known distances from each other.

11. A method of obtaining calibration data for use in calibrating a surface scanning system including a board on which marks are made, and a pan/tilt camera system for detecting and generating electronic images of the marks and of operating the surface scanning system, the method comprising:

positioning a preconfigured physical arrangement which embodies known dimensional data on a board of the scanning system, wherein the pre-configured physical arrangement comprises a substrate having a plurality of objects having printed fiducial markings at pre-determined locations on the substrate, the pre-determined locations being of a known distance from each other, and the plurality of objects having known dimensions, and the pre-configured physical arrangement further comprises a plurality of connection members connecting at least some of the plurality of objects to each other, the connection members having a known dimension, wherein at least some of the plurality of objects are selectively associated with the substrate via at least some of the plurality of connection members, wherein the known dimension of each connection member is utilized to facilitate calibration of the surface scanning system;

determining locations of objects of the preconfigured physical arrangement, wherein the locations of the objects are identified in an x,y coordinate system of the board;

using the determined locations in a calibration algorithm, wherein the calibration algorithm calibrates an area of the board viewed by the pan/tilt camera system with a physical location of a viewed area; and controlling movement of the pan/tilt camera system by use of pan and tilt operations based on the calibration results.

12. The method according to claim 11, wherein the pan and tilt operations include:

capturing images of sub-regions of the board;

reconstructing the image of the entire board using the subregion images;

using the preconfigured physical arrangement to calibrate operation of the camera to capture the images of the subregions of the board to reconstruct the image of the entire board.

* * * * *